US005101704A

United States Patent [19]

Jones et al.

[11] Patent Number: 5,101,704

[45] Date of Patent: Apr. 7, 1992

[54] SLICER KNIFE GUARD AND SHARPENER

[75] Inventors: Michael A. Jones, Troy; Neal H. Blackburn, Springfield, both of Ohio

[73] Assignee: Premark FEG Corporation, Wilmington, Del.

[21] Appl. No.: 657,232

[22] Filed: Feb. 15, 1991

[51] Int. Cl.[5] ..... B26D 7/12

[52] U.S. Cl. ..... 83/174; 51/248

[58] Field of Search ..... 83/174, 174.1, 478, 83/544–546, 676; 51/246, 247, 248

[56] References Cited

U.S. PATENT DOCUMENTS

| | | | |
|---|---|---|---|
| 1,424,875 | 8/1922 | Braun | 51/247 |
| 1,948,811 | 2/1934 | Van Berkel | 51/248 |
| 3,124,185 | 3/1964 | Karp | 83/174 X |
| 3,958,478 | 5/1976 | Camper | 83/174 |
| 3,986,304 | 10/1976 | Shie, III | 83/174.1 X |

FOREIGN PATENT DOCUMENTS

| | | | |
|---|---|---|---|
| 0090064 | 3/1982 | European Pat. Off. | 83/174 |

*Primary Examiner*—Frank T. Yost
*Assistant Examiner*—Eugenia A. Jones
*Attorney, Agent, or Firm*—Russell L. McIlwain

[57] ABSTRACT

Slicing machine has a protective knife or blade edge guard for that portion of the periphery of the circular knife which is not coverable by the conventional gauge plate during sharpening of the knife edge or cleaning of the face and rearside of the knife. The blade edge guard is fastened to a bearing block for the shaft which supports and drives the knife, by means of spaced spokes extending from the block to the guard. A parallel pair of the spokes support slotted plates which mount a knife sharpener having stones for grinding and honing the edge of the knife. The sharpener has fixed pins on a body portion thereof, which pins cooperate with open-ended slots in said plates to enable the sharpener to be readily moved between inactive and active positions and removable for cleaning, all with one hand positioning or movement of the sharpener.

1 Claim, 2 Drawing Sheets

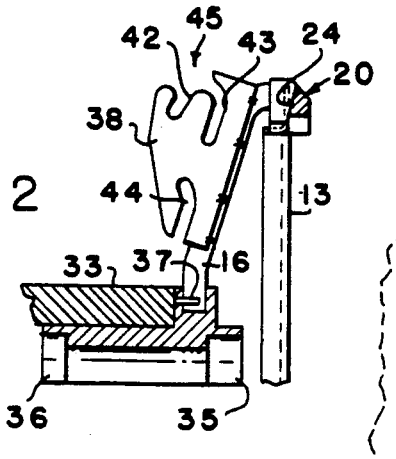
FIG. 2
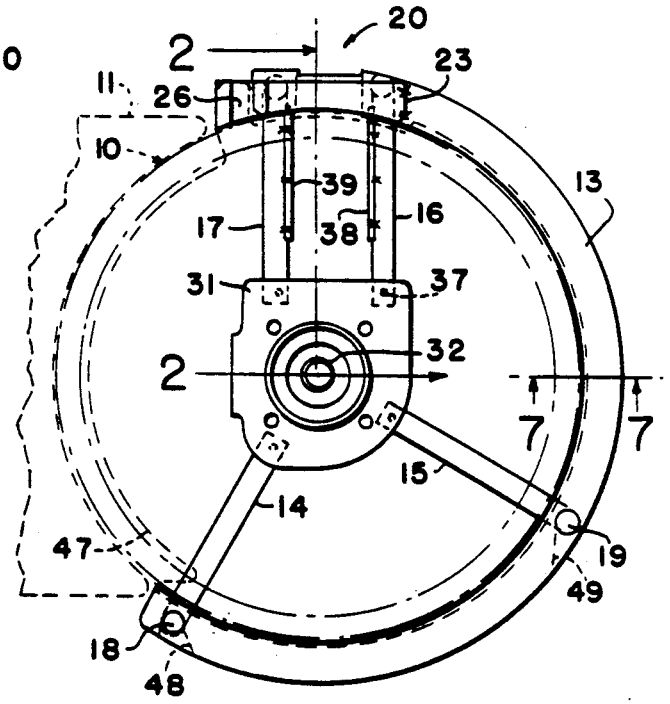
FIG. 1
FIG. 7
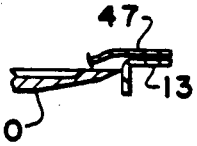
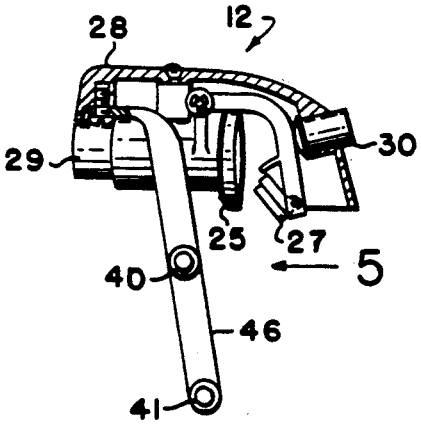
FIG. 5
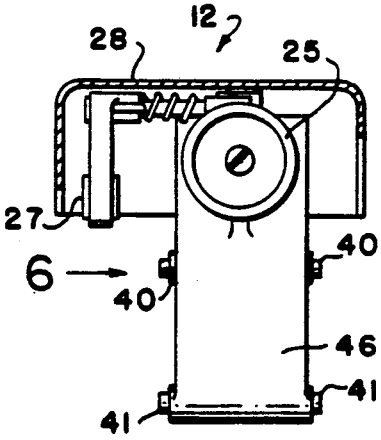
FIG. 6

SLICER KNIFE GUARD AND SHARPENER

BACKGROUND OF THE INVENTION

This invention relates generally to a food product slicer of the type having a rotatable circular or disc-like slicing knife, a gauge plate along one edge of the knife for determining the thickness of slices and a carriage, generally perpendicular to the face of the knife, for supporting food product as it is moved past the cutting edge of the knife during slicing. The invention relates to a means for guarding the periphery of the knife in combination with a knife sharpener carried by a portion of the guarding means. The guard is mounted on the slicing machine in a fashion which prevents removal thereof except under conditions where the knife itself is first removed. The invention additionally relates to a specific knife sharpener which can be easily moved between an inactive position and an active sharpening position and easily removed from the sharpener supporting means for cleaning remote from the machine, all with one hand. The sharpener is mountable on a portion of the means which supports the knife edge guard to provide for ease of manufacturing and accuracy of positioning the sharpener relative to a relieved or notched portion of the knife edge guard.

DESCRIPTION OF THE PRIOR ART

A number of commercial food slicers exist having knife edge guards which encompass approximately 360° of the edge of a circular knife. Some of these slicers also comprise top-mounted knife sharpeners. European Patent No. 90,064, issued on May 28, 1986, illustrates a slicer having the blade edge guard extending around approximately 240° of the knife. The gauge plate can be positioned to cover essentially the remaining 120°. The system further includes notched-out relief portions in the edge guard so that a top-mounted sharpener can have its sharpening stones engage the front and rear faces of the cutting edge to grind and hone a fine edge. The sharpener is removable to enable its being cleaned at a location away from the slicing machine.

Another relevant prior art slicer is disclosed in U.S. Pat. No. 3,124,185 granted to E. C. Karp on Mar. 10, 1964. Karp appears to show a blade edge guard mounted from a motor housing by a partially-open rear guard framework to enable cleaning of the rear side of the knife. A portion of the framework supports a quick-detach handle assembly which in turn supports a front guard plate. The assembly and front plate can be removed together when the knife is to be sharpened, temporarily exposing a segment of the knife edge until a sharper is removed from a storage location and placed in the position formerly occupied by the handle assembly. An alternative embodiment which is described in Karp has the sharpener mounted on the slice thickness gauge plate while it is set to its maximum thickness setting, thus exposing about 120° of the sharp knife edge during blade sharpening.

In addition, a sharpener is disclosed in U.S. Pat. No. 3,958,478 issued to William Camper on May 25, 1976 and assigned to Assignee of the present invention. That patent shows a sharpener which is movable by hand between inactive and active positions, but ordinarily requires the operator to use both hands on the sharpener during removal for cleaning.

It would be desirable to provide a slicer which improves over the prior art in respect of the mounting structure for the blade edge guard and knife sharpener, whereby the slicer can be readily cleaned and can be more easily manufactured and assembled. It would be further desirable to provide a sharpener mounting arrangement which permits the sharpener to be removed for cleaning in a single-handed operation.

SUMMARY OF THE INVENTION

One aspect of this invention relates to a protective slicer blade edge guard supported from a motor housing by means of spokes supporting both the guard and a knife sharpener. Certain of the spokes mount a knife sharpener for movement between inactive and active positions and easy, one-hand removal from the supporting means for cleaning. With respect to the peripheral portion of the blade normally used for slicing, i.e., the area adjacent a thickness gauge plate, in order to prevent contact with that area during sharpening, the gauge plate is to be placed in its "zero thickness" position so that it covers the knife edge in the area not encompassed by the blade edge guard. A generally circular surface plate is also mounted on the blade edge guard and covers the entire area of the face of the knife during a slicing operation, except for the area adjacent the cutting edge cross which food product passes during slicing. Such plates are common in the art. The latter plate is easily removable from the blade edge guard to enable cleaning of the face of the knife in its entirety after a slicing operation has been performed. The mounting means for supporting the blade edge guard consists of spokes which enable a large portion of the rearside of the knife to be exposed for hand cleaning by wiping with a cloth or other cleaning instrument. The sharpener is detachably mounted on side plates fastened to parallel ones of said spokes and is provided with pairs of laterally-protruding fixed pins. The pins engage in slots in the side plates to guide the sharpener for hand movement between its active and inactive positions. The slots are open-ended to the outer edges of the side plates to enable easy, one hand removal of the sharpener for cleaning.

BRIEF DESCRIPTION OF THE DRAWINGS

FIG. 1 is a front view of the blade edge guard, its supporting spokes and hub.

FIG. 2 is a vertical cross-sectional view taken substantially along lines 2—2 of FIG. 1.

FIG. 5 is a cross-sectional, elevational view of the sharpener on a somewhat enlarged scale in relation to FIG. 2, and is taken looking in the direction of the arrow 5 of FIG. 6.

FIG. 6 is a view of the sharpener taken looking in the direction of the arrow 6 of FIG. 5.

FIG. 7 is a cross-sectional view of portions of the blade edge guard, knife and cover plate and is taken substantially along lines 7—7 of FIG. 1.

DESCRIPTION OF THE PREFERRED EMBODIMENT

Figure 4:
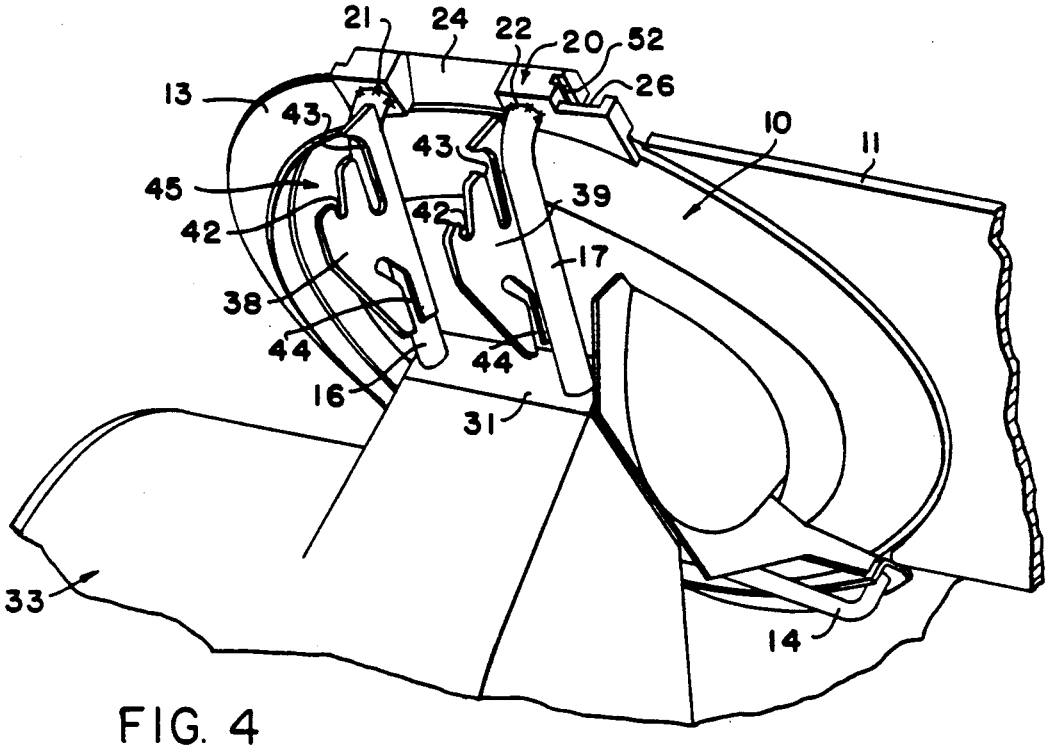
FIG. 4 is a perspective view taken from the rear of the slicing machine with the sharpener removed, showing the mounting spokes and bearing block or hub for the blade edge guard, which also function to support the knife sharpener.
Figure 3:
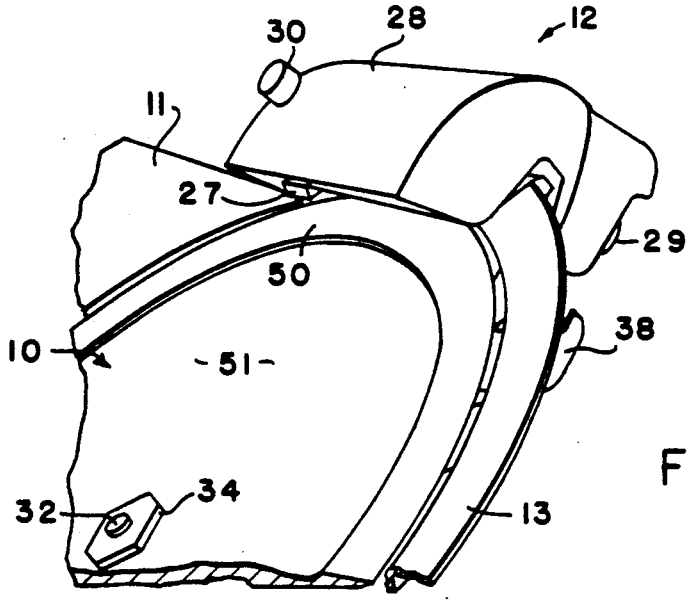
FIG. 3 is a perspective view taken from the front of the slicing machine and showing the top-mounted sharpener in active position to sharpen the circular knife.

A circular of disc-like slicing blade or knife 10 and a slice thickness gauge plate 11 are shown in dotted lines in FIG. 1 and in full lines in FIG. 4. They are conventional and are mounted on a base of a slicing machine. The machine conventionally includes a product-supporting carriage (not shown) which is reciprocated either manually by the slicing machine operator or driven by a motor in the case of an automatic slicer. Since all of these elements are old and well-known in the art, they will be described only briefly herein, it being understood that the knife is mounted for rotation on a fixed-axis shaft and the gauge plate is movable essentially laterally with respect to the plane of the knife for predetermining slice thickness. The gauge plate can also be located to the "zero" position wherein it encompasses or covers the periphery of the knife edge as shown in FIG. 3. With the gauge plate 11 in the covering position, a sharpener, generally designated by the numeral 12 in FIG. 3, can be moved to an active, sharpening position on the machine to "touch up" the knife edge by grinding along the outer rear face of the knife and finally honing the front edge or face to remove any burrs created by the grinding action.

The gauge plate 11 covers approximately one-third of the peripheral edge of the knife during the sharpening or cleaning operations. An edge guard 13 is supported by four spokes 14–17 in spaced-apart fashion so that a major portion of the underside or rear of the blade 10 is exposed for wiping as can be seen in FIG. 4. The outward ends of the spokes 14 and 15 have studs 18 and 19 welded thereto. Spokes 16 and 17 are welded to an edge protector 20, as at 21 and 22. The upper edge of the blade edge guard 13 is also welded to the edge protector 20 at 23. It can be seen, therefore, that blade edge guard 13, spokes 16 and 17 and edge protector 20 are integral, as by welding, for purposes to becomes apparent later. These elements are accurately held within an accurate fixture (not shown) during the welding operation. Edge guard 13 may be formed of flat metal stock. The guard 13 is L-shaped in cross-section as shown in FIG. 7 and is formed to its circular configuration prior to its being interconnected with a generally known edge protector 20. The ability to form the guard 13 of a flat strip of stock allows it to be made more economically than if machined from solid stock. The edge protector 20 performs similarly in some respects to that disclosed in EPO Patent 90,064 by providing relieved portions to allow for knife contact by sharpening and honing stones. The protector 20 provides an extension at one end of the edge guard 13. Relief 24 in protector 20 provides a notched portion in the blade edge guard to allow the sharpening wheel 25 shown in FIGS. 5 and 6 to grind the rear side of the edge of the knife when dressing its edge. Relief 26 provides a similar notched portion to allow contact by a honing stone 27 with the outer edge of the knife face, in order to create an extremely sharp edge after grinding has been done. Sharpening wheel 25 and honing stone 27 are engaged either simultaneously or successively by means of a person holding down on a hood 28 of the sharpener 12 when it is in active sharpening position and pressing with the thumb and one finger against buttons 29 and 30 in conventional fashion. Wheel 25 and stone 27 are spring-loaded away from the knife, and the spring bias is overcome by pressing lightly on buttons 29 and 30 to dress the edge of the knife while it is rotating. This sharpening method is common in the slicing machine art and need not be described in greater detail.

The spokes 14–17 are mounted in holes provided radially inwardly of a bearing block or hub 31 for the shaft 32 of a motor (not shown) mounted within housing 33. As shown in FIG. 3, the shaft 32 which drives the knife 10 has a nut or other fastener 34 for holding the knife 10 against a shoulder on the shaft. The shaft 32 is mounted in bearings (not shown) received in recessed bores 35 and 36 of hub 31 (FIG. 2). Design and construction is such that hub 31 must be removed from the housing 33 in order to enable the edge guard 13 to be removed from the machine with the spokes. It can be seen that the spokes 14–17 may be pinned to the hub 31 as by pins 37 in FIG. 2, requiring that even the pins cannot be removed to allow the spokes to be removed from the hub 31 unless the hub is first removed from the housing 33. In order to remove the hub 31, knife 10 must first be removed from shaft 32 and shaft 32 and hub 31 removed with the spokes and edge guard 13 as a unit, all as shown in solid lines in FIG. 1. The hub 31 is fastened to housing 33 by means of screws (not shown) passing through holes 53. For all practical purposes, the edge guard 13, block 31, edge protector 20 and spokes 14–17 are all interconnected once installed in a machine, and can be put into the machine during assembly or repair only prior to installation of the knife or can be removed from the machine only after the knife has been removed.

Referring now to the sharpener 12 and its mounting means, a pair of flat side plates 38 and 39 are individually welded to spokes 16 and 17, respectively. This welding was accomplished at the time the spokes 16 and 17, the edge protector 20 and the edge guard 13 were welded together in a fixture, to assume proper location and alignment of the elements. This allows the sharpener 12 shown in FIGS. 5 and 6 to be accurately positioned on the plates 38 and 39 by means of pairs of pins 40 and 41 which cooperate with pairs of slots 42–44 as shown in FIGS. 2 and 4. By referring to Camper U.S. Pat. No. 3,958,478, which patent is the predecessor design of the sharpener of this invention and is specifically incorporated by reference herein, it will be seen that (a) pins 40 and 41 will be received in slots 42 and 44 respectively when the sharpener is in an inactive (non-sharpening or storage) position at the top and rear of the slicer knife during normal slicing operation, (b) pins 40 can be lifted out of slots 42 and moved into slots 43 while pins 41 just move up and down within slots 44 to move the sharpener 12 to the active sharpening position shown in FIG. 3, and (c) the sharpener 12 can be simply removed from the machine by disengaging pins 40 from either of slots 42 or 44, tipping it counterclockwise by passage through openings 45 shown best in FIG. 2 and dropping pins 41 downwardly out of the open end of slots 44 to remove the sharpener 12 from the machine. All of the aforementioned movements of the sharpener can be easily accomplished with one hand, and without operating any latching mechanism. Removal is frequently required to clean the sharpener at a sink to remove any meat and fat residue or metal particles ground from the surface of the knife. A key improvement of the sharpener of certain claims this invention with respect to that of the aforementioned Camper patent is that the openings 45 in the plates 38 and 39 allow the one-hand operation during removal and installation of the sharpener.

As can be seen particularly in FIG. 4, the sole support for the sharpener in both its active and inactive positions are the vertical side plates 38 and 39. By being mounted via welding to spokes 16 and 17, the plates allow cleaning access between the spokes 16 and 17 as well as the areas on either side of any of the spokes 14–17. In addition, by assembling the plates 38 and 39, spokes 16 and 17, protector 20 and guard 13 in a fixture prior to welding all of those parts together, the slots 42 and 43 become very accurate guiding and positioning means for the pins 40 and 41. The bottoms of slots 42 and 43 provide steady positioning of the sharpener in its inactive and active positions, the latter of which is achieved prior to sharpening the knife. Proper slot-bottoming of the pins 40 in relation to the edge of the knife allows dressing of the cutting edge until such time that the diameter of the knife has reduced through repeated sharpening to a point at which the knife should be replaced.

Shown in dotted lines in FIG. 1, a generally circular plate 47 is notched as at 48 and 49 to be received in necked-down portions of studs 18 and 19. The screws have their heads extending above the top surface of the blade edge guard 13 to accommodate capture of the plate 47 at notches 48 and 49. The left edge of the plate 47 is made essentially coplanar with the surface 50 of the knife face so that food product being sliced passes across the surface 50 and is supported by the plate 47. Plate 47 is essentially recessed within the area 51 of the knife as shown in FIG. 3. Latch means (not shown) is mounted on and carried by the plate 47 in the area of relief 26 of the edge protector 20 and is actuatable to engage with or disengage from a slot 52 (FIG. 4) to mount the plate 47 in fixed position during a slicing operation. The design of the plate 47 enables the latch means to be disengaged, plate 47 moved slightly outwardly and upwardly away from the face of the knife and rocked a small amount clockwise about stud 19. At that time, notch 48 will disengage from stud 18. Notch 49 may then be disengaged from stud 19 by lifting the plate 47 upwardly. Reinstallation of the plate 47 is done in reverse order, by first placing notch 49 over the the necked-down stud 19, rocking it counterclockwise until notch 48 engages over the necked-down stud 18, dropping the latch means into relief 26 and turning the latch to engage with slot 52 of the edge protector 20. Once latched, plate 47 has been fastened at three points to provide sufficient stability to support the weight of the product being sliced.

Having described our invention, we claim:

1. In a food product slicer having a base, a motor-driven, disc-like slicing knife mounted on said base and having a peripheral cutting edge, and a food product carriage mounted for horizontal reciprocation along said base to carry product to be sliced into contact with and past the cutting edge, a knife sharpener and fixed means supporting said sharpener adjacent an edge of said knife on its side opposite said carriage, said sharpener having a pair of sharpening stones engageable with opposite sides of the peripheral edge to grind and hone said cutting edge, said sharpener further having an inactive sharpener-mounting position on said slicer wherein sharpening stones are out of contact with the cutting edge and an active, sharpening position wherein the stones are in sharpening contact with the knife edge, the improvement comprising mounting means for said sharpener to enable free and easy manual operator movement between said inactive and active positions and further enabling ready manual removal of the sharpener from the fixed means for cleaning the sharpener at a location remote from the slicer, said mounting means including:

a body supporting said stones, said body having parallel vertical sides;

a first pair of fixed, aligned horizontal pins protruding laterally from an upper portion of said body;

a second pair of fixed, aligned horizontal pins parallel to said first pair and protruding laterally from a lower portion of said body;

a pair of parallel side plates fixed relative to said base and having inner surfaces spaced apart essentially the horizontal dimension of the sides of said body, each of said plates having an upper edge and a lower edge;

a first like pair of open-ended slots extending downwardly from the upper edges of the plates to bottom stops for receiving the first pair of pins to locate the sharpener in said inactive position;

a second like pair of open-ended slots extending downwardly from the upper edges of the plates to bottom stops for receiving the first pair of pins to enable positioning of the sharpener in said active position, said second slots being located between said first slots and said knife; and a third pair of open-ended slots extending upwardly from the lower edges of said plates for receiving the second pair of pins for guiding the sharpener during manual movement between said active and inactive positions and allowing the sharpener to be removed from the slicer by disengaging the first pair of pins from the slots with which they cooperate to thereby allow the second pair of pins to be lowered to disengage from the third pair of slots, the vertical depth of said third pair of slots preventing the second pair of pins from disengaging thereform until said first pair of pins are outward of the plates.

* * * * *